US007159529B2

(12) United States Patent
Durand et al.

(10) Patent No.: US 7,159,529 B2
(45) Date of Patent: Jan. 9, 2007

(54) INFLATABLE BOAT WITH A HIGH PRESSURE INFLATABLE KEEL

(75) Inventors: Manuel Durand, Roses (ES); Lionel Boudeau, Roses (ES)

(73) Assignee: Zodiac International (FR)

( * ) Notice: Subject to any disclaimer, the term of this patent is extended or adjusted under 35 U.S.C. 154(b) by 0 days.

(21) Appl. No.: 11/148,456

(22) Filed: Jun. 9, 2005

(65) Prior Publication Data

US 2006/0096517 A1 May 11, 2006

(30) Foreign Application Priority Data

Jun. 11, 2004 (FR) ..... 04 06372

(51) Int. Cl.
*B63B 7/00* (2006.01)
*B63B 35/58* (2006.01)

(52) U.S. Cl. ..... 114/345; 441/40

(58) Field of Classification Search ..... 114/345, 114/40; 441/40–42, 131, 44, 45
See application file for complete search history.

(56) References Cited

U.S. PATENT DOCUMENTS 5,943,978 A 8/1999 Garnier
5,964,176 A 10/1999 Grunau et al.
6,209,476 B1 * 4/2001 Maurel et al. ..... 114/345

FOREIGN PATENT DOCUMENTS

| | | |
|---|---|---|
| FR | 1155376 | 4/1958 |
| FR | 2458449 | 1/1981 |
| FR | 2510064 | 1/1983 |
| FR | 2722758 | 1/1996 |
| FR | 2734234 | 11/1996 |
| FR | 2795040 | 12/2000 |

OTHER PUBLICATIONS

Search Report issued in priority Application No. 0406372.

* cited by examiner

*Primary Examiner*—Jesús D. Soteló
(74) *Attorney, Agent, or Firm*—Dean W. Russell; Kilpatrick Stockton LLP

(57) ABSTRACT

An inflatable boat comprising: an inflatable float that is U-shaped and open at the stern, and that braced by a transom; a floor that is disposed inside the space defined by the float, and a V-shaped keel formed of a flexible canvas sheet fastened to the float and to the transom and tensioned by a longitudinal inflatable keel-forming spacer interposed between the floor and the canvas sheet;

the inflatable keel-forming spacer is formed by at least two elongate and flat chambers inflated under a relatively high pressure; and the two chambers have their respective bottom longitudinal edges touching and their respective top longitudinal edges spaced apart from each other so that the keel-forming spacer is generally V-shaped in cross-section.

12 Claims, 4 Drawing Sheets

FIG. 7.
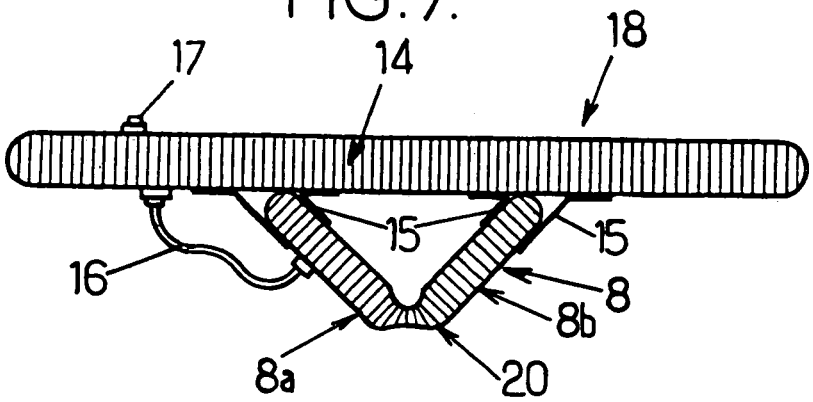
FIG. 8.
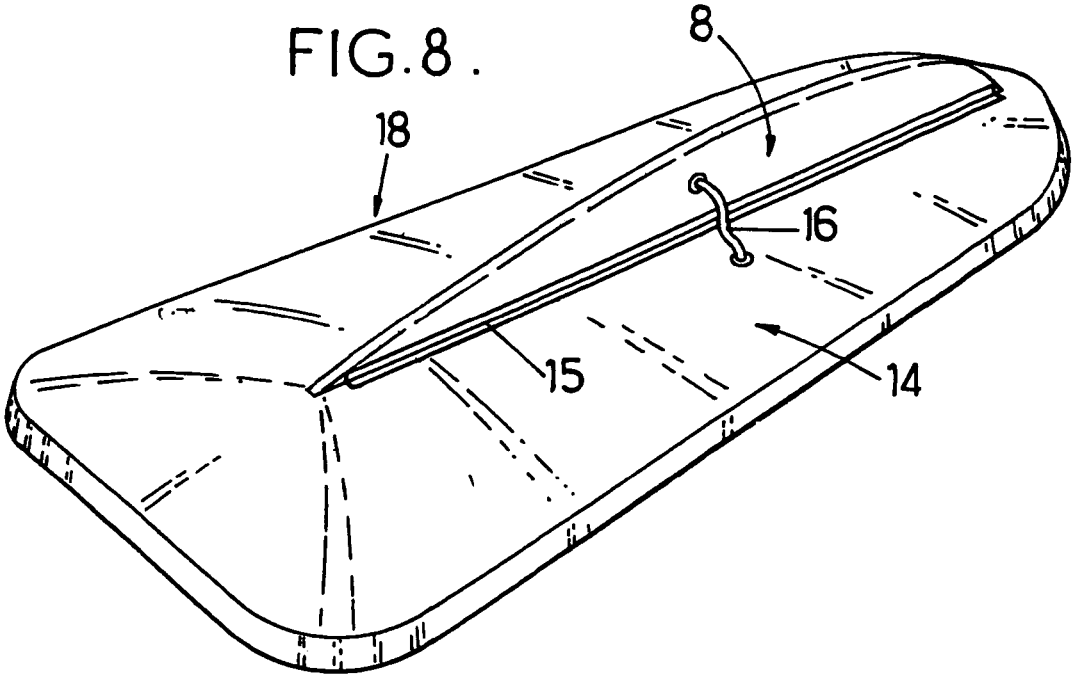
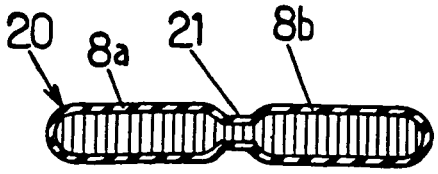
FIG. 9.
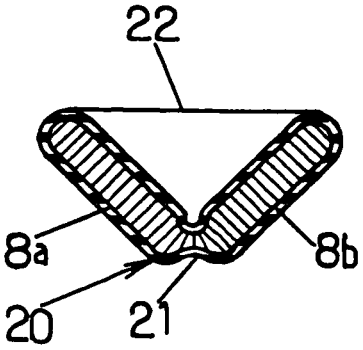
FIG. 10.

INFLATABLE BOAT WITH A HIGH PRESSURE INFLATABLE KEEL

CROSS REFERENCE TO RELATED APPLICATION

This application claims priority to French Patent Application No. 04 06372 filed on Jun. 11, 2004, the contents of which are incorporated by reference herein.

FIELD OF THE INVENTION

The present invention relates generally to the field of inflatable boats, and it relates more specifically to improvements made to inflatable boats of the type comprising: a float that is generally U-shaped and open at the stern, and that is made up of at least one pneumatically inflatable tube whose aft ends are braced by a transom; a floor that is rigid at least transversely and that is disposed inside the space defined by the float, and a V-shaped keel formed of a flexible canvas sheet fastened to the float and to the transom and tensioned by a longitudinal inflatable keel-forming spacer interposed between said floor and said canvas sheet.

BACKGROUND OF THE INVENTION

Boats arranged in this way are already known, in particular from documents FR 1 155 376, FR 2 510 064, FR 2 734 234, and FR 2 795 040.

The well known advantage of inflatable keel-forming spacers compared with rigid keel-forming spacers, e.g. keel-forming spacers that are made of wood, lies in their light weight, and in the ease with which the boat as deflated and folded can be stored and carried.

Unfortunately, such inflatable keel-forming spacers suffer from a drawback that lies in the narrowness of the zone in which they are in contact with the floor. If the floor is insufficiently rigid, it can, over time, end up curving significantly in its central longitudinal region. Such a drawback might remain relatively insignificant with a floor made of wood or of a lightweight metal, regardless of whether it is made up of juxtaposed slats or of juxtaposed panels. However, the problem can arise more significantly with inflatable floors, i.e. floors formed by a flat chamber braced internally by ties and inflated under a relative high pressure.

Although the floor deforming to some extent does not jeopardize the capacities of the boat as regards both handling and safety, it does however appear highly desirable to prevent such deformation, or at least to minimize it so that it is no longer perceptible.

OBJECT AND SUMMARY OF THE INVENTION

Essentially, the object of the invention is to propose an original and inexpensive solution for solving the problem posed, without that also resulting in a significant modification to the general structure of the boat.

To these ends, in an inflatable boat as mentioned in the introduction above and as arranged in accordance with the invention, the inflatable keel-forming spacer is formed by at least two elongate chambers, each of which is defined by two substantially plane and parallel main walls that are braced by a multitude of flexible ties, each chamber being inflated under a relatively high pressure, and the two chambers are disposed with their respective bottom longitudinal edges touching and with their respective top longitudinal edges spaced apart from each other so that the keel-forming spacer is generally V-shaped in cross-section.

By means of these provisions, the composite keel-forming spacer of the invention continues to perform its function under the same conditions as a single inflatable keel-forming spacer, and in particular as an inflatable keel-forming spacer inflated under a relatively high pressure like the keel-forming spacer of Document FR 2 795 040. However, unlike a single keel-forming spacer, and in particular unlike the relatively high-pressure inflatable keel-forming spacer of Document FR 2 795 040 which bears against the floor over a narrow region only and which is thus characteristic of keel-forming spacers of the state of the art and suffers from the above-mentioned drawbacks thereof, the composite keel-forming spacer of the invention bears against the floor at two locations that are spaced apart from each other: thus the two component chambers of the keel-forming spacer of the invention define a wide bearing surface in the central longitudinal region of the floor, thereby tending to avoid or at least to reduce curvature thereof.

The arrangement of the invention can lead to multiple variant embodiments.

In particular, it is possible to make provision for the keel-forming spacer to comprise two chambers that are independent from each other.

It is also possible to make provision for the keel-forming spacer to comprise a single pouch that is flat in general shape and that is folded to form said two chambers that are inclined relative to each other in a V-shaped configuration. In which case it is advantageous for the single pouch that is flat in general shape to have at least one longitudinal constriction defining two communicating chambers situated on either side of said constriction, and for said pouch to be folded along said constriction to form said two chambers that are inclined relative to each other in a V-shaped configuration.

Commonly, the touching bottom edges of the inflatable chambers are curvilinear. In which case, it is desirable for the height of the chambers to increase very rapidly from the forward end to define a bow portion, and then to decrease gradually sternwards, and for the maximum height of the chambers in the vicinity of the forward end to be relatively large in order to impart to the tensioned canvas sheet the shape of a sharp bow portion that forms a relatively closed V-shape.

In a preferred embodiment, the floor is an inflatable floor formed of a flat pouch defined by two approximately parallel main walls that are braced by a multitude of flexible ties, said pouch being inflated under a relatively high pressure, and the inflatable chambers forming the keel-forming spacer are secured longitudinally and axially to the bottom face of said inflatable floor so as to form a single piece. It is then possible to make provision for a pneumatic communication link to be established between firstly the inflatable floor and secondly the inflatable chambers forming the keel-forming spacer, and for the single piece to be equipped with a single valve for simultaneously inflating the floor and the chambers forming the keel-forming spacer. It is then possible to consider making provision for the keel-forming spacer to be formed of two pouches, each of which has a longitudinal constriction which defines two communicating chambers situated on either side of said constriction, for each pouch to be folded along its constriction, and for two base-forming side chambers to be secured to the bottom face of the inflatable floor so that the central other two chambers are inclined relative to each other in a V-shaped configuration. In which case, permanent communication link may be established between the inflatable floor and, for each pouch, said base-forming chamber secured to said floor.

A variant embodiment of the above-described structure consists in that the keel-forming spacer comprises a pouch having three longitudinal constrictions which define four communicating chambers, in that the pouch is folded along its constrictions, and in that two base-forming side chambers are secured to the bottom face of the inflatable floor so that the central other two chambers are inclined relative to each other in a V-shaped configuration. A single piece is thus obtained that is easy to install and that is inflatable in a single operation.

BRIEF DESCRIPTION OF THE DRAWINGS

The invention will be better understood on reading the following detailed description of certain particular embodiments which are given merely by way of non-limiting example. In the description, reference is made to the accompanying drawings, in which:

FIG. 7 is a very diagrammatic cross-section view showing a preferred example of an arrangement of the inflatable floor and of the inflatable keel-forming spacer of the dingy of FIG. 6 in the form of a single T-shaped piece;

FIG. 8 is a view in perspective of the single piece of FIG. 7, shown upside down (keel-forming spacer upwards);

FIG. 9 shows an advantageous embodiment of the inflatable keel-forming spacer implemented in the arrangement of FIG. 7;

FIG. 10 shows a variant embodiment of the inflatable keel-forming spacer of FIG. 9;

DETAILED DESCRIPTION OF THE INVENTION

Figure 1:
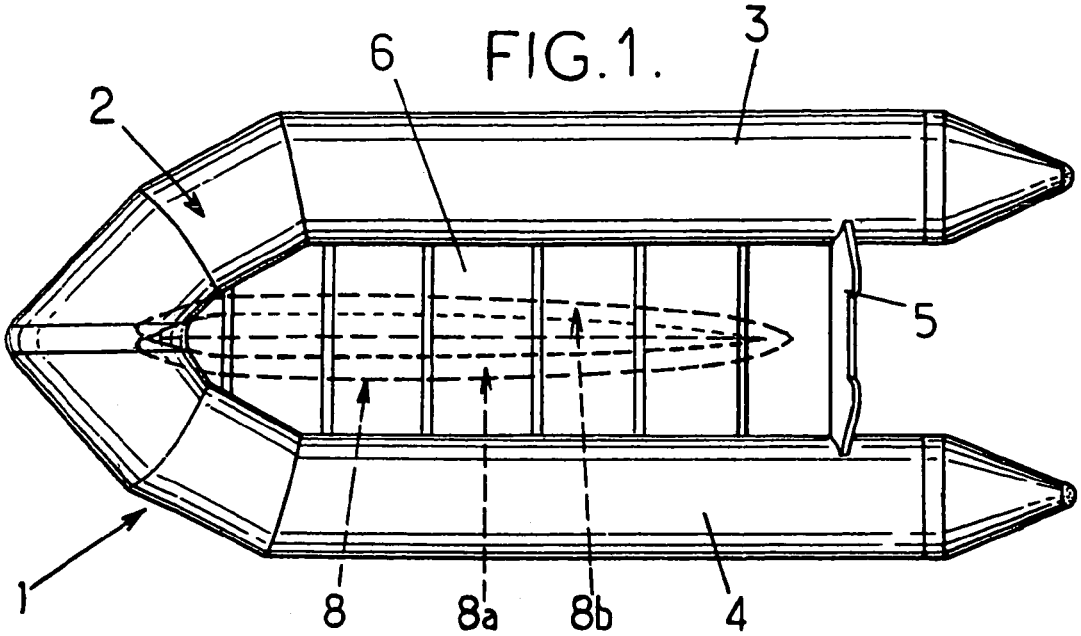
FIGS. 1 and 2 are diagrammatic views respectively from above and from the side, showing the whole of an inflatable boat equipped with a keel-forming spacer of the invention.
Figure 2:
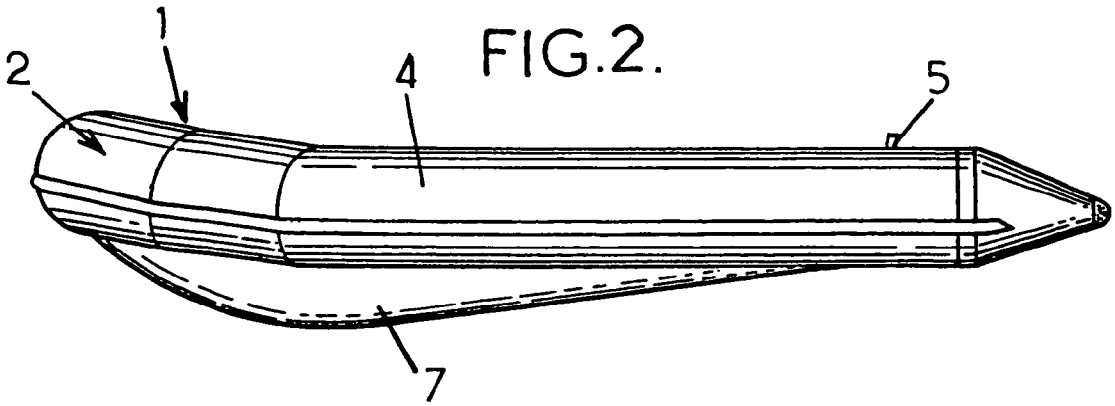
Figure 3:
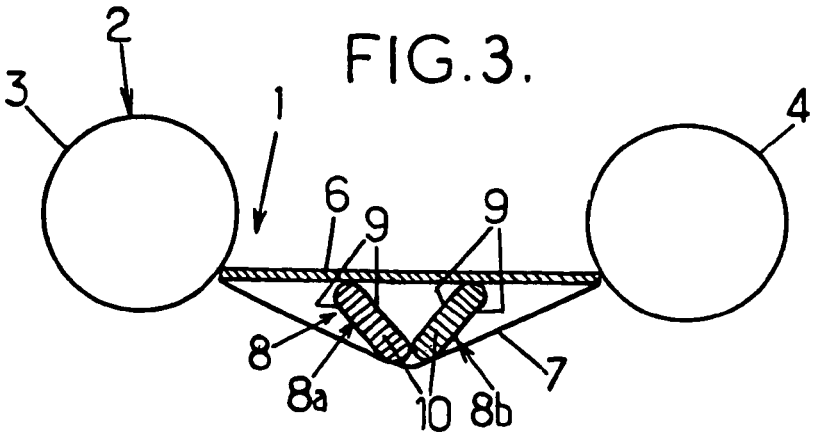
FIG. 3 is a very diagrammatic cross-section view of the boat shown in FIGS. 1 and 2.

With reference firstly to FIGS. 1 to 3, the inflatable boat, designated by overall numerical reference 1, comprises a float 2 that is generally U-shaped, that is open at the stern, and that is constituted by a least one pneumatically inflatable tube whose branches 3 and 4 are substantially parallel. Said branches are, at their aft ends, braced by a transom 5.

Inside the space defined by the U-shaped float 2 and by the transom 5, there extends a floor 6 that is fastened to the float and to the transom, and that is rigid, at least transversely.

In the example shown in FIGS. 1 to 3, the rigid floor is made up of slats or panels extending transversely to the branches 3, 4 of the tube, said slats or panels, in particular made of wood or of metal, being hinged together.

Finally a bottom sheet constituting a V-shaped keel is formed of a flexible canvas sheet that is fastened to the float 2 and to the transom 5 and that is tensioned by an elongate inflatable keel-forming spacer 8 disposed axially between the rigid floor 6 and the flexible canvas sheet 7.

The general arrangement of this type of boat is known, for example, from Document FR 1 155 376, with a keel-forming spacer formed of a chamber inflated under the same relatively low inflation pressure as the float 2.

Figure 5:
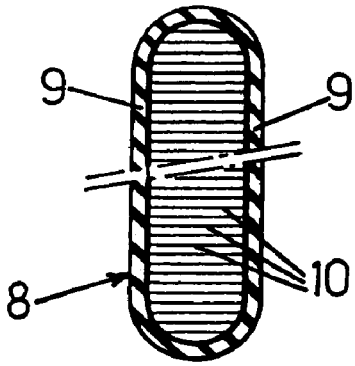
FIG. 5 is a diagrammatic cross-section view of a chamber constituting the inflatable keel of FIG. 3.

In the invention, the inflatable keel-forming spacer 8 is formed by at least two elongate chambers 8*a*, 8*b*, each of which is defined by two main walls 9 that are substantially plane and approximately parallel main walls 9 that extend longitudinally and that are braced by a multitude of flexible ties 10 which, with the chamber being inflated under a relatively high pressure (to give some idea: e.g. about $10^5$ pascals (Pa), while the float is inflated under a significantly lower pressure, e.g. about $0.2\times10^5$ Pa to about $0.3\times10^5$ Pa), hold the main walls in a predetermined relative position, in particular approximately plane and parallel to each other as shown in FIGS. 3 and 5. In addition, the two chambers 8*a*, 8*b* are disposed with their respective bottom longitudinal edges touching each other, and with their respective top edges spaced apart from each other, so as to present a generally V-shaped cross-section.

The arrangement of each chamber 8*a*, 8*b* of the inflatable keel-forming spacer 8 is shown on a larger scale in FIG. 5. The walls 9 can advantageously be made in multi-layer form and the ties 10 can be formed by wires anchored in the thickness of the walls 9, using a technique that is well known to the person skilled in the art.

By means of this structure, it is possible to give the inflatable keel-forming spacer 8 any desirable shape firstly by using a shape that differs from the tubular shape that is currently used and that gives rise to a rounded bow portion which is insufficiently sharp and which limits the handling characteristics of the dingy, and secondly by giving the keel-forming spacer a wider area via which it bears against the bottom face of the floor.

Figure 4:
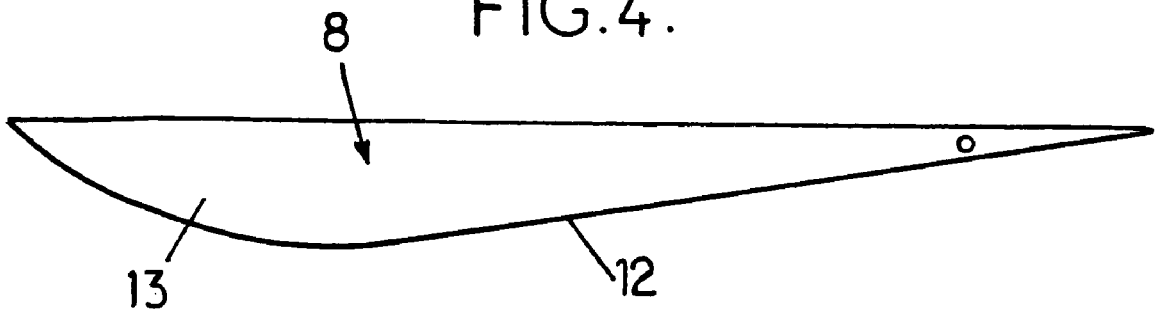
FIG. 4 is a diagrammatic side view showing, on its own, the inflatable keel-forming spacer of the boat of FIGS. 1 to 3.

In the context of the invention, it is possible to impart to each chamber 8*a*, 8*b* of the keel-forming spacer 8 a flat sheet-like shape whose thickness is considerably smaller than its height and than its length, as can be seen more particularly in FIGS. 3, 4, and 5. In addition, it is possible to adapt the angle of mutual inclination of the two chambers 8*a*, 8*b* as a function of needs, and it is possible, optionally, to have an angle that varies longitudinally. It is thus possible to make the bow portion 11 very sharp, enabling it to part the water better.

In addition, it is possible to impart to the inflatable keel-forming spacer 8 any desirable shape. In particular, the bottom edge 12 of the keel-forming spacer can be curved with its height being at its maximum at the bow portion 13 and decreasing gradually sternwards, as can be seen more clearly in FIGS. 2 and 4.

It is thus possible to impart to the keel-forming spacer a general shape that is analogous to the shape of a rigid keel (e.g. a wooden keel), with, at the bow portion 13, a height that is considerably greater than the height of a conventional tubular inflatable keel-forming spacer. This large height procures a very pronounced bow portion imparting more stable course-holding to the boat.

In addition, the fact that the two chambers 8*a*, 8*b* are inflated under a relatively high pressure makes the keel-forming spacer 8 very rigid, and almost as rigid as a conventional rigid keel. The drawback of the relative longitudinal deformability of conventional inflatable keel-forming spacers that are inflatable under low pressures is thus avoided.

The combination of the rigidity, of the sharpness, and of the large height at the bow portion of the keel-forming spacer of the invention makes it possible to impart optimum characteristics to the bow portion that significantly improve the performance of the boat.

Figure 6:
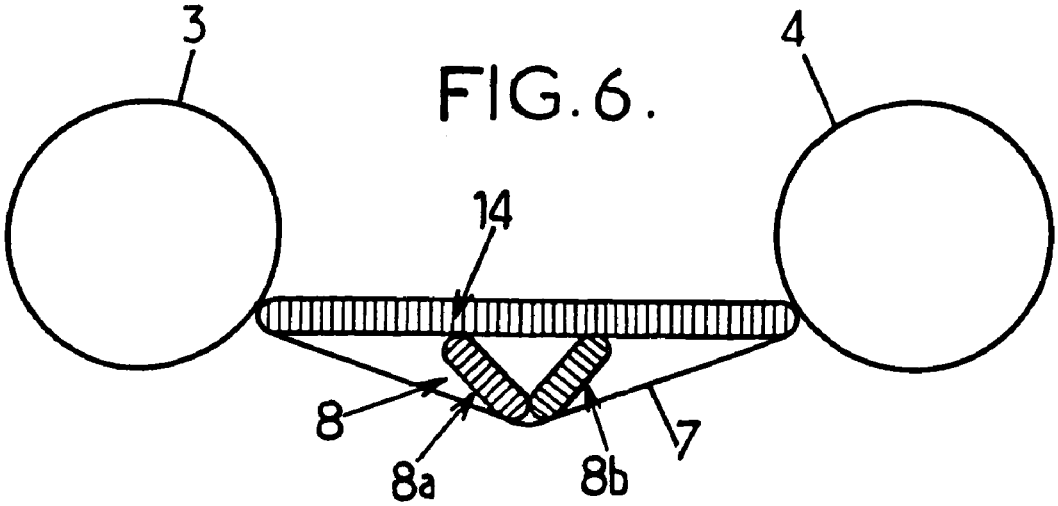
FIG. 6 is a very diagrammatic cross-section view of a preferred variant arrangement of an inflatable dingy equipped with an inflatable floor and with an inflatable keel-forming spacer of the invention.

FIG. 6 is a very simplified cross-section view showing an arrangement of a boat in which the floor is constituted, in a manner known per se, in the form of a flat pouch 14 defined by two approximately parallel main walls braced by a multitude of flexible ties, the pouch being inflated under a relatively high pressure, using a technique analogous to the technique for constituting the keel-forming spacer of the invention. Inflatable boats equipped with such inflatable floors are commonly commercially available.

Combining, in the same boat, a floor and a keel-forming spacer, both of which are constituted analogously and are inflatable under a relatively high pressure, makes the boat very rigid and makes it entirely deflatable and foldable, without voluminous rigid elements that are awkward to carry and to stow.

It is more precisely in the context of such an inflatable floor that the keel-forming spacer having at least two chambers in a V-shaped configuration offers a definite advantage, so that the resulting keel-forming spacer bears against the bottom face of the inflatable floor over a wider region so as to avoid, or at least to reduce, curving of the floor in the presence of the tension force due to the tensioned canvas forming the bottom 7.

As shown in FIG. 7, it is possible to consider constituting the inflatable floor 14 and the inflatable keel-forming spacer 8 in the form of a single piece 18 that is generally T-shaped in cross-section. To this end, the floor 14 and the keel-forming spacer 8 can be made using the same technique in the form of two independent elements that are then secured together, e.g. by adhesive bonding or by sealing, with reinforcing and holding brackets 15 being affixed. In order to simplify implementation of the two pouches that are of the same design and that are inflatable under the same pressure, it is possible to provide a pneumatic link between them (e.g. a link tube 16), while only one of them (e.g. the inflatable floor 14 that is easier to access from the inside of the boat) is equipped with a common inflation valve 17.

FIG. 8 is a perspective view of the single piece 18 shown upside-down, with the keel-forming spacer 8 upwards, and as inflated.

Admittedly, the keel-forming spacer 8 can be formed by two chambers 8*a*, 8*b* that are independent from each other and that are assembled together and to the floor 14 by means of brackets. However, such an arrangement requires assembly at a multitude of points, and also suitable pneumatic links between the floor and each of the chambers 8*a*, 8*b*.

However, making the single piece 18 is facilitated if the keel-forming spacer 8 is itself constituted by a single pouch folded in a V-shaped configuration to define the two chambers 8*a*, 8*b*.

An embodiment that is preferred because of the simplicity it procures for manufacturing the component parts is shown in FIGS. 7 and 9.

Firstly, a flat pouch 20 (FIG. 9) is made from the above-indicated material, and a constriction 21 is formed in its central region. The constriction 21 extends longitudinally and allows one or more passageways to remain for enabling the inflation air to pass between the communicating chambers 8*a* and 8*b* that are situated on either side. The longitudinal constriction 21 constitutes a fold score line enabling the two chambers 8*a*, 8*b* to be disposed in the required mutually inclined configuration, in their inflated state, as shown in FIG. 7.

By way of a variant, the single pouch 20 can be held in the folded position by means of stiffeners interposed between the two chambers 8*a*, 8*b* defined in this way, as shown in FIG. 10. For example, the stiffener means can consist of a continuous strip of woven fabric, or else of a plurality of strip segments 22 (as shown in FIG. 10) secured (bonded by adhesive or by sealing) to the respective end edges of the two chambers 8*a*, 8*b*. The resulting keel-forming spacer 8 can be secured to the bottom face of the floor 14 by means of brackets 15, as indicated above, but it is also possible, by way of a variant, to consider securing said stiffener means, in particular the strip segments 22, to said face in order to secure the keel-forming spacer thereto.

Figure 11:
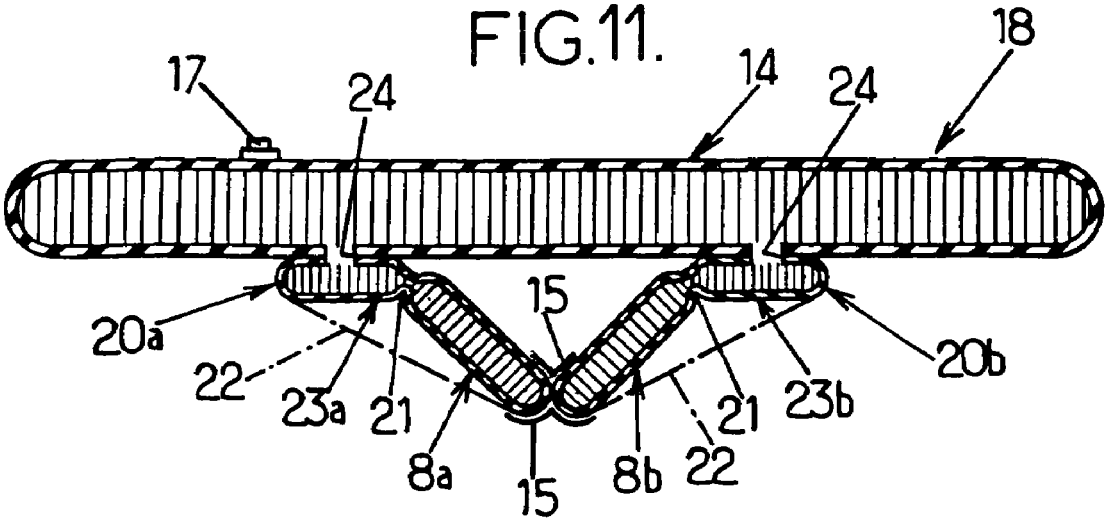
FIG. 11 shows yet another variant embodiment of an inflatable keel-forming spacer of the invention.

Also by way of a variant, the single pouch 20 can be mounted significantly differently to the manner indicated above. In this context, as shown in FIG. 11, two pouches 20*a*, 20*b* are implemented, each of which comprises two communicating chambers 23*a*, 8*a*; 23*b*, 8*b* respectively, separated by a constriction 21. The two pouches 20*a*, 20*b* are secured, parallel to each other, to the bottom face of the inflatable floor 14 via one of their respective chambers 23*a*, 23*b* which are spaced apart from each other at a distance smaller than the sum of the widths of the two juxtaposed chambers 8*a*, 8*b*: as a result, since the two chambers 8*a*, 8*b* cannot bear against the floor 14, they are positioned in a V-shaped configuration. Advantageously, passageways 24 (in the form of holes) can be established through the juxtaposed walls of the floor 14 and of the respective ones of the chambers 23*a*, 23*b* so as to procure a direct pneumatic link between the floor 14 and the chambers 23*a*, 23*b*, and thus the chambers 8*a*, 8*b*, thereby enabling the inflatable structure as a whole to be inflated directly under a relatively high pressure.

Optionally, the touching edges of the two chambers 8*a*, 8*b* can be assembled together and reinforced by means of brackets 15. In order to improve overall stiffness, it is also possible to provide strip segments 22 (shown in chain-dotted lines) dimensioned to hold the two chambers 8*a*, 8*b* in a relative position having the desired angle of mutual inclination.

Figure 12:
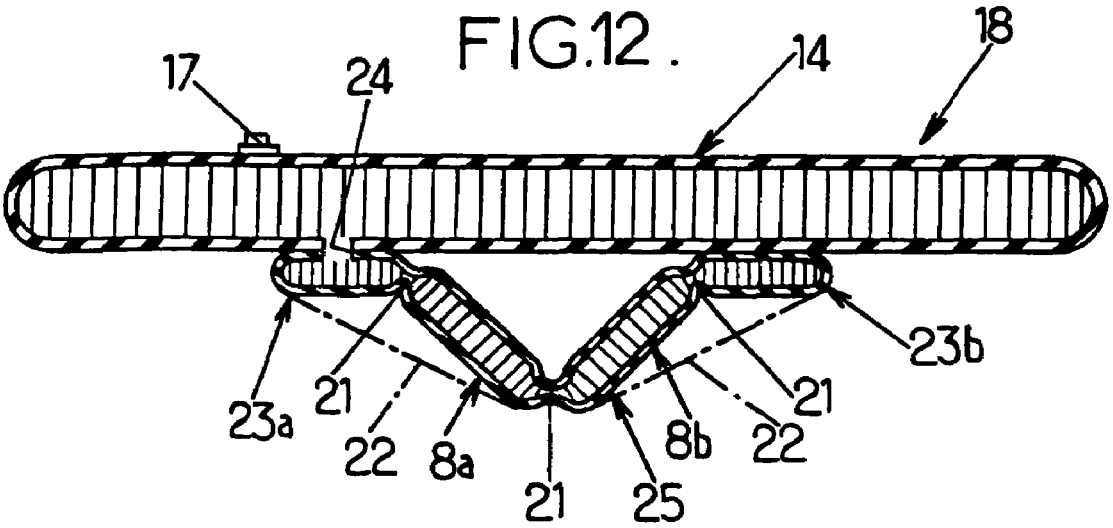
FIG. 12 shows an advantageous variant embodiment of the inflatable keel-forming spacer of FIG. 11.

An advantageous variant embodiment of the above-described assembly consists, as shown in FIG. 12, in that the pouches 20*a*, 20*b* are made in one-piece form, as a single pouch 25 provided with three longitudinal constrictions 21 that are spaced apart from one another and mutually parallel, and that define between them the above-mentioned communicating chambers 8*a*, 23*a*, 23*b*, and 8*b*. A single passageway 24 allows the assembly to be inflated in one operation. Optionally, the rigidity of the assembly can be improved by providing strip segments 22 under the same conditions as above.

The two embodiments of FIGS. 11 and 12 make it possible to constitute a single inflatable piece 18 that is suitable for being installed rapidly and that is inflatable under a relatively high pressure in a single operation by means of a single inflation valve 17.

What is claimed is:

1. An inflatable boat defining a bow, a stern, a midsection intermediate the bow and the stern, and a longitudinally-central plane and comprising: a float that is generally U-shaped and open at the stem, and that is made up of at least one pneumatically inflatable tube whose aft ends are braced by a transom; a floor that is rigid at least transversely and that is disposed inside the space defined by the float, and a V-shaped hull formed of a flexible canvas sheet fastened to the float and to the transom and tensioned by a longitudinal inflatable keel-forming spacer interposed between said rigid floor and said canvas sheet;

wherein the inflatable keel-forming spacer is formed by at least two elongate, substantially flat inflatable chambers which extend between said rigid floor and said canvas sheet and which have respective lower edges joined together and resting against said canvas sheet and respective upper edges spaced apart transversely and resting against said rigid floor at locations symmetric with respect to the longitudinally-central plane of the boat and, at least in the midsection of the boat, at locations laterally remote from the tube, with said two chambers being together disposed in a substantially V-shaped configuration in cross-section; and wherein said two chambers are each defined by two substantially plane and parallel main walls that are braced by a multitude of flexible ties, said at least two chambers being inflated under a relatively high pressure.

2. A boat according to claim 1, wherein the keel-forming spacer comprises two chambers that are independent from each other.

3. A boat according to claim 1, wherein the keel-forming spacer comprises a single pouch that is flat in general shape and that is folded to form said two chambers that are inclined relative to each other in a V-shaped configuration.

4. A boat according to claim 3, wherein the single pouch that is flat in general shape has at least one longitudinal constriction defining two communicating chambers situated on either side of said constriction, and wherein said pouch is folded along said constriction to form said two chambers that are inclined relative to each other in a V-shaped configuration.

5. A boat according to claim 1, wherein the joined together lower edges of the inflatable chambers are curved.

6. An inflatable boat according to claim 5, wherein the height of the chambers increases very rapidly from the forward end to define a bow portion, and then decreases gradually sternwards, and wherein the maximum height of the chambers in the vicinity of the forward end is relatively large in order to impart to the tensioned canvas sheet the shape of a sharp bow portion that forms a relatively closed V-shape.

7. An inflatable boat according to claim 1, wherein the floor is an inflatable floor formed of a flat pouch defined by two approximately parallel main walls that are braced by a multitude of flexible ties, said pouch being inflated under a relatively high pressure, and wherein the inflatable chambers forming the keel-forming spacer are secured longitudinally and axially to the bottom face of said inflatable floor so as to form a single piece.

8. An inflatable boat according to claim 7, wherein a pneumatic communication link is established between firstly the inflatable floor and secondly the inflatable chambers forming the keel-forming spacer, and wherein the single piece is equipped with a single valve for simultaneously inflating the floor and the chambers forming the keel-forming spacer.

9. An inflatable boat according to claim 7, wherein the keel-forming spacer comprises two pouches each of which has a longitudinal construction which defines two communicating chambers situated on either side of said constriction;

wherein each pouch is folded along its constriction; and wherein two base-forming side chambers are secured to the bottom face of the inflatable floor so that the central other two chambers are inclined relative to each other in a V-shaped configuration.

10. A boat according to claim 9, wherein a permanent communication link is established between the inflatable floor and, for each pouch, said base-forming chamber secured to said floor.

11. A boat according to claim 7, wherein the keel-forming spacer comprises a pouch having three longitudinal constrictions which define four communicating chambers;

wherein the pouch is folded along its constrictions; and wherein two base-forming side chambers are secured to the bottom face of the inflatable floor so that the central other two chambers are inclined relative to each other in a V-shaped configuration.

12. An inflatable boat comprising: a float that is generally U-shaped and open at the stem, and that is made up of at least one pneumatically inflatable tube whose aft ends are braced by a transom; a floor that is rigid at least transversely and that is disposed inside the space defined by the float, and a V-shaped hull formed of a flexible canvas sheet fastened to the float and to the transom and tensioned by a longitudinal inflatable keel-forming spacer placed between said floor and said canvas sheet;

wherein the inflatable keel-forming spacer is formed by at least two elongate chambers, each of which is defined by two substantially plane and parallel main walls that are braced by a multitude of flexible ties, each chamber being inflated under a relatively high pressure; and wherein the two chambers are disposed with their respective bottom longitudinal edges touching and resting against the canvas sheet and with their respective top longitudinal edges resting against the floor and spaced apart from each other so that the two chambers together disposed are generally V-shaped in cross-section.

* * * * *